US008461500B2

(12) United States Patent
Choi et al.

(10) Patent No.: US 8,461,500 B2
(45) Date of Patent: Jun. 11, 2013

(54) MICROWAVE OVEN

(75) Inventors: Sung-Ho Choi, Changwon (KR); Kyu-Young Kim, Changwon (KR); Jae-Myung Chin, Changwon (KR); Sang-Ryul Lee, Changwon (KR); Dong-Han Kim, Changwon (KR); Si-Young Choi, Changwon (KR)

(73) Assignee: LG Electronics Inc., Seoul (KR)

( * ) Notice: Subject to any disclaimer, the term of this patent is extended or adjusted under 35 U.S.C. 154(b) by 265 days.

(21) Appl. No.: 12/743,195

(22) PCT Filed: Nov. 17, 2008

(86) PCT No.: PCT/KR2008/006769

§ 371 (c)(1),
(2), (4) Date: Sep. 23, 2010

(87) PCT Pub. No.: WO2009/064149

PCT Pub. Date: May 22, 2009

(65) Prior Publication Data

US 2011/0017729 A1 Jan. 27, 2011

(30) Foreign Application Priority Data

| | | |
|---|---|---|
| Nov. 16, 2007 | (KR) | 10-2007-0117550 |
| Nov. 16, 2007 | (KR) | 10-2007-0117552 |
| Nov. 16, 2007 | (KR) | 10-2007-0117553 |
| Nov. 16, 2007 | (KR) | 10-2007-0117556 |
| Nov. 16, 2007 | (KR) | 10-2007-0117559 |
| Nov. 20, 2007 | (KR) | 10-2007-0118648 |

(51) Int. Cl.
*H05B 6/64* (2006.01)
*H05B 6/80* (2006.01)

(52) U.S. Cl.
USPC ..... 219/757; 219/702; 219/704

(58) Field of Classification Search
USPC ..... 219/757, 702, 704, 705, 710, 711, 219/715, 723, 758, 690, 681, 756
See application file for complete search history.

(56) References Cited

U.S. PATENT DOCUMENTS

| | | | | |
|---|---|---|---|---|
| 7,214,915 | B2 * | 5/2007 | Yamaguchi et al. | 219/757 |
| 2008/0296292 | A1 | 12/2008 | Byun | |

FOREIGN PATENT DOCUMENTS

| | | | | |
|---|---|---|---|---|
| CN | 1626890 | A | | 6/2005 |
| JP | 63201427 | A | * | 8/1988 |
| KR | 20-0229276 | Y1 | | 7/2001 |
| KR | 2001-0109947 | A | | 12/2001 |
| KR | 10-0402578 | B1 | | 10/2003 |
| KR | 10-0402587 | B1 | | 10/2003 |
| KR | 10-2005-0100243 | A | | 10/2005 |
| KR | 10-2005-0100245 | A | | 10/2005 |
| KR | 10-2005-0100246 | A | | 10/2005 |
| KR | 10-0525263 | B1 | | 11/2005 |
| KR | 10-2006-0013982 | A | | 2/2006 |
| KR | 10-2006-0096711 | A | | 9/2006 |
| KR | 10-2006-0120838 | A | | 11/2006 |
| KR | 10-20074-0008045 | A | | 1/2007 |
| KR | 10-0686772 | B1 | | 2/2007 |
| KR | 10-2007-0094358 | A | | 9/2007 |
| KR | 10-2007-0099548 | A | | 10/2007 |
| KR | 10-0767850 | B1 | | 10/2007 |
| KR | 10-0774503 | B1 | | 11/2007 |

* cited by examiner

*Primary Examiner* — Quang Van
(74) *Attorney, Agent, or Firm* — Birch, Stewart, Kolasch & Birch, LLP

(57) ABSTRACT

A microwave oven is provided. A component generating relatively high temperature heat and a component generating a relatively low temperature heat are cooled by airflow divided and provided by a cooling part, thereby improving operation reliability and durability of a product.

52 Claims, 7 Drawing Sheets

MICROWAVE OVEN

TECHNICAL FIELD

The present disclosure relates to a microwave oven, and more particularly, to a microwave oven adapted to more efficiently cool components.

BACKGROUND ART

Microwave ovens are cooking appliances configured to cook foods using microwave and/or heat. Such a microwave oven includes an electronic component for generating microwave and/or a heater for generating heat. The microwave oven also includes a cooling system configured to cool the electronic component and/or the heater.

DISCLOSURE OF INVENTION

Technical Problem

An object of the present disclosure is to provide a microwave oven configured to more efficiently cool components.

Technical Solution

In one embodiment, a microwave oven includes: a cavity including a cooking chamber; a first component and a second component, both at a surface of the cavity; a third component at a rest of the surface of the cavity provided with the first and second components; and a cooling part providing an airflow adapted for cooling the first and third components, the cooling part providing an airflow adapted for cooling the second component and separated from the airflow adapted for cooling the first and third components.

In another embodiment, a microwave oven includes: a cavity including a cooking chamber; a first component at a surface of the cavity; a second component at the surface of the cavity provided with the first component, the second component generating higher temperature heat than the first component; a first cooling part providing an airflow adapted to cool the first component; and a second cooling part providing an airflow adapted to cool the second component, wherein the airflow adapted to cool the second component is separated from the airflow adapted to cool the first component, and is discharged to an outside in a state of being spaced apart from a component requiring cooling and provided to the cavity.

In further another embodiment, a microwave oven includes: an electronic component-cooling passage where air flows, the air cooling an electronic component provided to an upper surface of a cavity, the air flowing along a rear surface and a bottom surface of the cavity and discharged to an indoor space; and a heater-cooling passage where air flows, the air being separated from the electronic component-cooling passage and cooling a heater provided to the upper surface of the cavity.

In further another embodiment, a microwave oven includes: a cavity including a cooking chamber and an electronic chamber; a first passage at an upper surface of the cavity; a second passage at the upper surface of the cavity, the second passage being separated from the first passage; a third passage at a side surface of the cavity; a fourth passage at a rear surface of the cavity; a fifth passage at the rear surface of the cavity, the fifth passage being separated from the fourth passage; and a sixth passage at a bottom surface of the cavity.

Advantageous Effects

According to embodiments, components are cooled more efficiently.

BEST MODE FOR CARRYING OUT THE INVENTION

Hereinafter, a microwave oven according to an embodiment will now be described with reference to the accompanying drawings.

Figure 1:
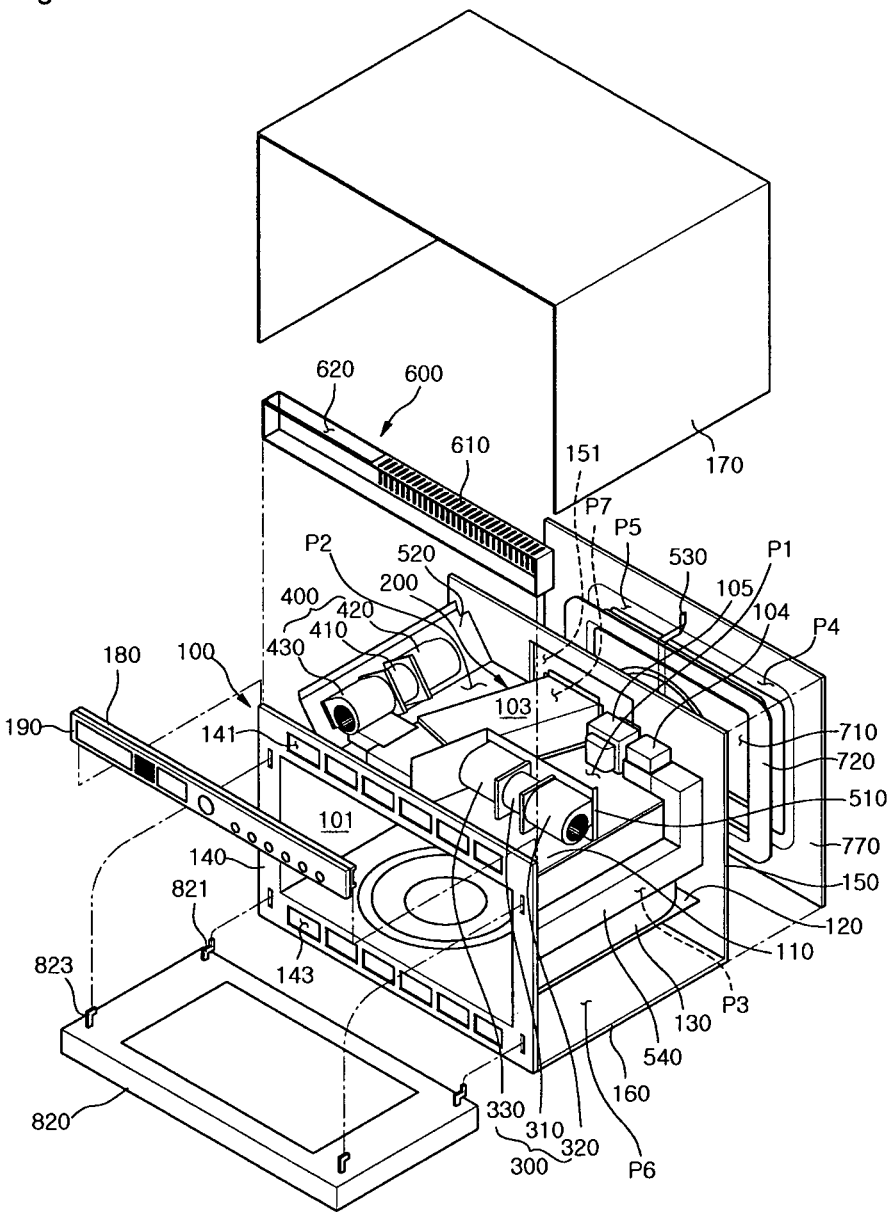
FIG. 1 is an exploded perspective view illustrating a microwave oven according to an embodiment.
Figure 2:
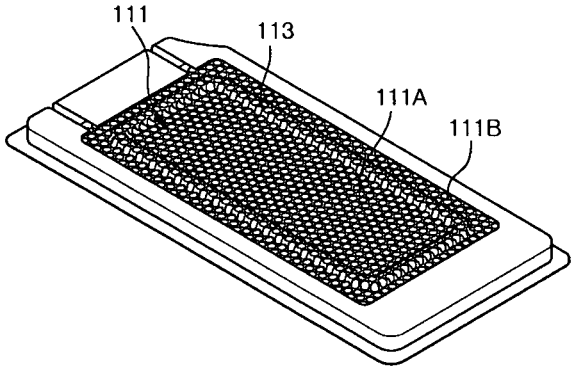
FIG. 2 is a perspective view illustrating a multi-hole part according to an embodiment.
Figure 3:
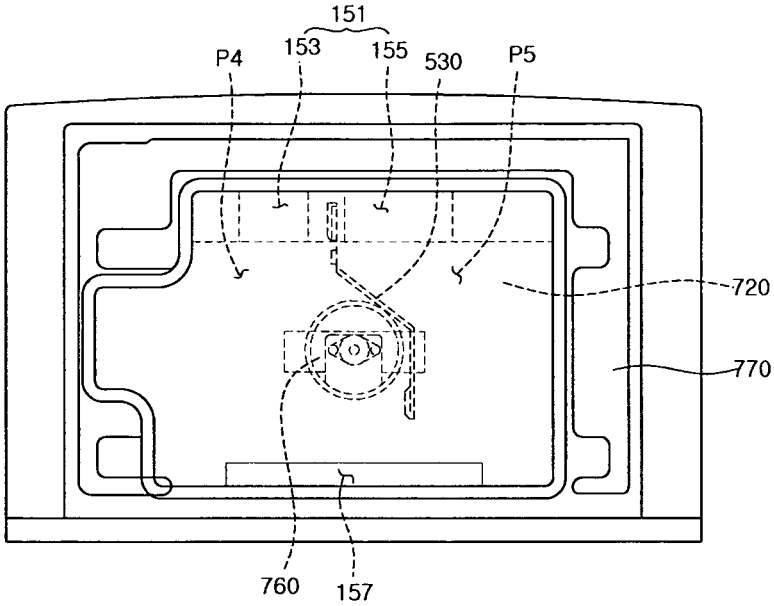
FIG. 3 is a rear view illustrating a rear surface according to an embodiment.
Figure 4:
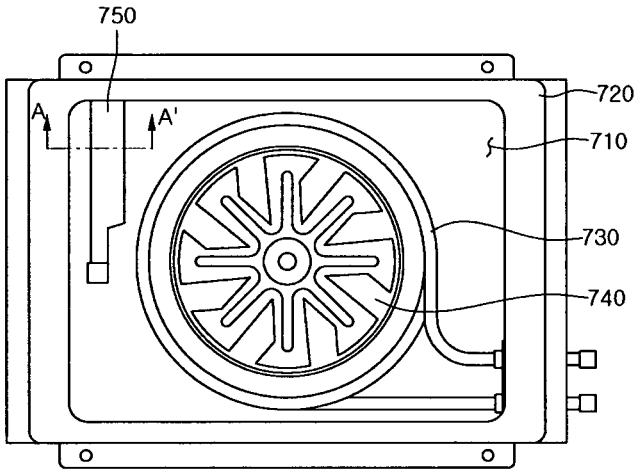
FIG. 4 is a front view illustrating an inner portion of a convection chamber according to an embodiment.
Figure 5:
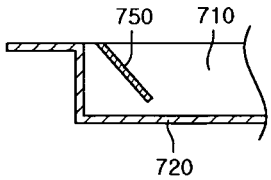
FIG. 5 is a cross-sectional view taken along line A-A' of FIG. 4.
Figure 6:
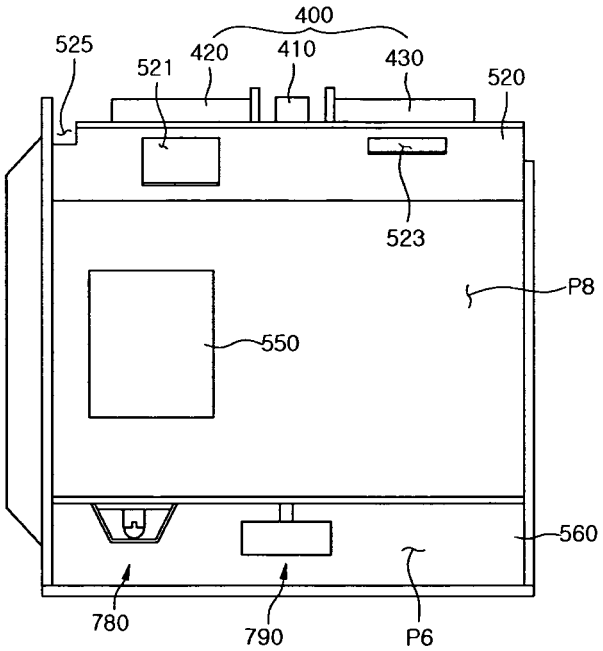
FIG. 6 is a side view illustrating a side surface according to an embodiment.
Figure 7:
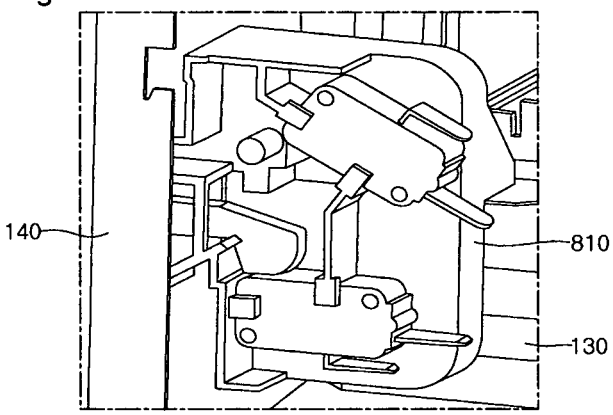
FIG. 7 is a perspective view illustrating a part including a latch board according to an embodiment.

FIG. 1 is an exploded perspective view illustrating the microwave oven according to the embodiment. FIG. 2 is a perspective view illustrating a multi-hole part 111 according to the embodiment. FIG. 3 is a rear view illustrating a rear surface according to the embodiment. FIG. 4 is a front view illustrating an inner portion of a convection chamber 710 according to the embodiment. FIG. 5 is a cross-sectional view taken along line A-A' of FIG. 4. FIG. 6 is a side view illustrating a side surface according to the embodiment. FIG. 7 is a perspective view illustrating a part including a latch board 810 according to the embodiment.

Referring to FIGS. 1 to 7, a cavity 100 of the microwave oven has an upper surface, a bottom surface, and both side surfaces that are provided with an upper plate 110, a bottom plate 120, and an inner plate 130, respectively. The inner plate 130, having a C-shape opened entirely forward, includes a rear surface and a couple of side surfaces.

Front and rear ends of the cavity 100 are coupled with a front plate 140 and a back plate 150, respectively. The front plate 140 and the back plate 150 substantially define a front appearance and a rear appearance of the microwave oven. The front plate 140 and the back plate 150 respectively include rectangular plates extending out of the upper surface of the upper plate 110, the bottom surface of the bottom plate 120, and the side surfaces of the inner plate 130.

A lower portion of the cavity 100 is coupled with a base plate 160. Front and rear ends of the base plate 160 are fixed to a lower end of the front plate 140 and a lower end of the back plate 150. The base plate 160, coupled to the lower portion of the cavity 100, is spaced a predetermined distance from the bottom plate 120.

An upper portion and both sides of the cavity 100 are coupled with an outer case 170. The outer case 170 includes an upper surface and a couple of side surfaces, and has a C-shape opened entirely downward. In the state where the outer case 170 is coupled to the upper portion and both sides of the cavity 100, the upper surface and the side surfaces of the outer case 170 are spaced a predetermined distance from side surfaces of the upper plate 110 and the inner plate 130, respectively.

A cooking chamber 101 is disposed in the cavity 100. Substantially, a top surface, a bottom surface, a rear surface and both side surfaces of the cooking chamber 101 are provided by the upper plate 110, the bottom plate 120 and the rear and side surfaces of the inner plate 130, respectively. The cooking chamber 101 is a place where foods are cooked by microwaves and/or heat.

A space between the upper surfaces of the upper plate 110 and the outer case 170 includes an electronic chamber 103. The electronic chamber 103 is provided with electronic components for generating microwaves, an upper heater assembly 200 for generating heat, and a first and a second fan assemblies 300 and 400 for cooling the electronic components and the upper heater assembly 200. The electronic components include a magnetron 104 and a high voltage transformer 105.

Referring to FIG. 2, the electronic chamber 103 adjacent to the high voltage transformer 105, substantially, the left side of the upper plate 110 with respect to the drawing is provided with the multi-hole part 111. The multi-hole part 111 of the upper plate 110 is provided entirely in a long rectangular shape in an inclined direction at a predetermined angle with respect to a longitudinal axis. The multi-hole part 111 of the upper plate 110 is covered with a heater glass (not shown).

The multi-hole part 111 includes a reinforcing bead 113. The reinforcing bead 113 is provided in a closed curve shape having approximately a predetermined thickness at a portion of the multi-hole part 111. This prevents microwaves from concentrating on an edge provided to the reinforcing bead 113. In other words, when the reinforcing bead 113 is provided in an open curve shape, this prevents microwaves from concentrating on both ends of the reinforcing bead 113. In this embodiment, the reinforcing bead 113 is provided entirely in a rectangular shape, but is not limited thereto. For example, the reinforcing bead 113 may have an oval shape or a track shape.

Referring again to FIG. 1, the upper heater assembly 200 is provided on the electronic chamber 103 corresponding to the multi-hole part 111. The upper heater assembly 200 generates heat for heating foods with radiation in the cooking chamber 101. Detailed configuration of the upper heater assembly 200 will be described later.

The first fan assembly 300 is disposed transversely on the right front side of the electronic chamber 103 with respect to the drawing, corresponding to the front side of the electronic components. The first fan assembly 300 includes a single fan motor 310 and a couple of fans 320 and 330. Hereinafter, the fan 320 on the right side in the drawing is referred to as a first fan 320, and the fan 330 on the left side in the drawing is referred to as a second fan 330. The first fan 320 of the first fan assembly 300 introduces indoor air to cool the electronic components including the magnetron 104 and the high voltage transformer 105, and forms airflow for discharging oil or steam from the cooking chamber 101. The second fan 330 of the first fan assembly 300 introduces indoor air to form airflow for cooling, with covering, the high voltage transformer 105 and a convection motor 760 that will be described later. To this end, the first fan 320 of the first fan assembly 300 introduces air from the right side of the electronic chamber 103 to discharge the air to the magnetron 104. The second fan 330 of the first fan assembly 300 introduces indoor air from the left side of the electronic chamber 103 to discharge the air to the high voltage transformer 105 to the rear side of the drawing.

The second fan assembly 400 is disposed longitudinally in the left end of the electronic chamber 103, corresponding to the left side of the upper heater assembly 200 with respect to the drawing. The second fan assembly 400 includes a single fan motor 410 and a couple of fans 420 and 430 respectively provided on both sides of the fan motor 410. Hereinafter, the fan 420 on the rear side in the drawing is referred to as a first fan 420, and the fan 430 on the front side in the drawing is referred to as a second fan 430. The first fan 420 of the second fan assembly 400 forms airflow for cooling a lower heater 780 and a turn table motor 790 that will be described later. To this end, the first fan 420 of the second fan assembly 400 introduces indoor air and a portion of air moved by the second fan 330 of the first fan assembly 300, into the rear portion of the electronic chamber 103 and discharges them to the lower side in the drawing. The second fan 430 of the second fan assembly 400 forms airflow for cooling the upper heater assembly 200, and airflow cooling for the lower heater 780 and the turn table motor 790. To this end, the second fan 430 of the second fan assembly 400 introduces indoor air to the front portion of the electronic chamber 103 to discharge the air to the upper heater assembly 200 and the lower side of the drawing. That is, the second fan 430 of the second fan assembly 400 includes first and second discharge part 433 and 434 (refer to FIG. 12), so as to discharge air substantially in two directions. The second fan assembly 400 forming airflow is selectively driven depending on whether the upper heater assembly 200 operates. That is, the second fan assembly 400 is driven when the upper heater assembly 200 is turned on, and is not when the upper heater assembly 200 is turned off. Detailed configuration of the second fan 430 of the second fan assembly 400 will be described later.

The electronic chamber 103 includes a first air barrier 510. The first air barrier 510 prevents air discharged by the first fan assembly 300 from going back to the first fan assembly 300. Also, the first air barrier 510 substantially separates the right front portion of the electronic chamber 103 where the first fan assembly 300 is disposed, from the rest of the electronic chamber 103 where the electronic components and the upper heater assembly 200 are disposed.

The first air barrier 510 includes a couple of outlets (not shown). The outlets of the first air barrier 510 are configured to deliver air discharged from the first and second fans 320 and 330 of the first fan assembly 300 to the electronic chamber 103.

The electronic chamber 103 also includes a second air barrier 520. The second air barrier 520 prevents air discharged from the second fan assembly 400 from going back to the second fan assembly 400. In this embodiment, the second air barrier 520 extends from the left edge in the upper end of the cavity 100 toward the edge between the upper surface and side surface of the outer case 170.

The second air barrier 520 includes a couple of outlets 521 and 523 (refer to FIG. 6). Through the outlets 521 and 523 of the second air barrier 520, air is discharged from the first and second fans 420 and 430 of the second fan assembly 400 to the space between the side surface on the left side of the inner plate 130 and the side surface on the right side of the outer case 170. The second air barrier 520 also includes a communication opening 525. The communication opening 525 is provided by cutting partially the rear end of the second air barrier 520 corresponding to the rear portion of the first fan 420 of the second fan assembly 400. The communication opening 525 is adapted to flow a portion of air moved by the second fan 330 of the first fan assembly 300 to the space between the side surface on the left side of the inner plate 130 and the side surface on the left side of the outer case 170 even when the first fan 420 of the second fan assembly 400 is stopped (it will be appreciated that since the first and second fans 420 and 430 of the second fan assembly 400 are integrally driven by the fan motor 410, the first and second fans 420 and 430 of the second fan assembly 400 are simultaneously stopped). The second air barrier 520 will be further described in the detailed description of the second fan assembly 400.

The upper and lower ends of the front plate 140 are provided with a plurality of inlets 141 and a plurality of outlets 143, respectively. The inlets 141 and the outlets 143 of the front plate 140 are respectively provided by cutting the upper end and lower end of the front plate 140 in a predetermined shape. The inlets 141 and the outlets 143 of the front plate 140 respectively function as an entrance and an exit through which air is introduced and discharged by the first and second fan assemblies 300 and 400.

The front end of the upper plate 110, corresponding to the rear portion of the inlets 141 in the front plate 140 is provided with an intake grill 600. The intake grill 600 guides indoor air introduced through the inlets 141 of the front plate 140 to the first and second fan assemblies 300 and 400. The intake grill 600 prevents the introduction of outside foreign substances and prevents heat of the upper heater assembly 200 from being transferred to the indoor space.

To this end, the intake grill 600 is transversely provided approximately in a hexahedron shape having an open front surface. Thus, the intake grill 600 longitudinally communicates with the inlets 141 of the front plate 140.

A plurality of inlet holes 610 are provided to the front and rear surfaces of the intake grill 600 corresponding to the right side of the intake grill 600 in the drawing, corresponding to the front portion of the first fan assembly 300. An intake opening 620 is provided to the upper surface of the intake grill 600 corresponding to the left side of the intake grill 600 in the drawing, corresponding to the front side of the upper heater assembly 200 and the second fan assembly 400. The inlet holes 610 have a smaller transverse width than the intake opening 620. As such, the left and right portions of the intake grill 600 in the drawing have different configuration for air intake, which is because of an install direction of the first and second fan assemblies 300 and 400. More particularly, since intake parts of the first fan assembly 300 for air intake are disposed transversely, although the inlet holes 610 are provided to the rear surface of the intake grill 600, outside foreign substances cannot be introduced into the intake parts of the first fan assembly 300. However, since intake parts of the second fan assembly 400 are disposed longitudinally, if the intake opening 620 is provided to the front surface on the left side of the intake grill 600 in the drawing, corresponding to the front portion of the second fan assembly 400, outside foreign substances can be introduced through the intake opening 620 to the intake part of the second fan assembly 400. Thus, on the left side of the intake grill 600 in the drawing, the intake opening 620 is provided only to the upper surface.

The upper end of the front plate 140 is provided with a control bracket 180. The control bracket 180 is provided in a plate shape having a width corresponding to the transverse width of the front plate 140. The front surface of the control bracket 180 is flush with the front surface of the front plate 140.

The front surface of the control bracket 180 is provided with a control panel 190. The control panel 190 receives various operating signals for the operation of the microwave oven, and displays information about the operation of the microwave oven. The control panel 190 provided to the control bracket 180 covers the inlets 141 of the front plate 140 and partially covers the upper portion of the inlet holes 610 in the intake grill 600.

The control panel 190 is cooled by indoor air introduced through the inlets 141 of the front plate 140, and the inlet holes 610 and the intake opening 620 of the intake grill 600. To improve cooling efficiency of the control panel 190, a heat sink (not shown) may be provided to the inner surface of the control panel 190 adjacent to the inlet holes 610 and the intake opening 620 of the intake grill 600.

Referring to FIGS. 1 and 3, the upper and lower ends of the back plate 150 are provided with an intake opening 151 and a discharge opening 157. The intake opening 151 and the discharge opening 157 of the back plate 150 are formed by cutting a portion of the back plate 150 corresponding to the upper side of the upper plate 110 and the lower side of the bottom plate 120. The intake opening 151 of the back plate 150 functions as an entrance where air cooling the upper heater assembly 200 and air cooling the high voltage transformer 105 are introduced. Hereinafter, a portion of the intake opening 151 of the back plate 150 communicating with the electronic chamber 103, corresponding to the rear side of the high voltage transformer 105 is referred to as an electronic chamber intake opening 153, and a portion of the intake opening 151 of the back plate 150 communicating with the upper heater assembly 200 is referred to as a heater intake opening 155. The discharge opening 157 of the back plate 150 communicates with the space between the bottom plate 120 and the base plate 160, so as to function as an exit adapted to discharge air introduced through the intake opening 151 of the back plate 150.

Referring again to FIG. 1, the convection chamber 710 is provided on the rear side of the back plate 150 corresponding to the rear surface of the cooking chamber 101. The convection chamber 710 communicates with the cooking chamber 101. The convection chamber 710 is defined substantially by the back plate 150 and a convection cover 720 provided to the inner surface of the back plate 150. The convection cover 720 is provided approximately in a flat hexahedron shape having an open front surface.

Referring to FIGS. 3 and 4, a convection heater 730 and a convection fan 740 are disposed in the convection chamber 710. The convection heater 730 may include a sheathe heater bent entirely in a ring shape. The convection fan 740 is disposed in the convection heater 730, and rotates about a longitudinally horizontal rotation shaft. The convection fan 740 introduces air to the center thereof and discharges the air radially.

The convection heater 730 and the convection fan 740 are configured to heat foods in the cooking chamber 101 with convection. That is, when the convection fan 740 is driven, a food in the cooking chamber 101 is convection-heated by air including heat from the convection heater 730 and circulating in the cooking chamber 101 and the convection chamber 710.

For the driving of the convection fan 740 to transfer heat of the convection heater 730 more uniformly to the inner space of the cooking chamber 101, a first air guide 750 is disposed in the convection chamber 710. The first air guide 750 guides air discharged by the driving of the convection fan 740 to the edge of the cooking chamber 101. To this end, referring to FIG. 4, the front portion of the first air guide 750 is inclined at a predetermined angle in the radial direction of the convection fan 740, i.e., toward the cooking chamber 101. The first air guide 750 is nonsymmetric with respect to the rotation center of the convection fan 740. Thus, air including heat from the convection heater 730, by convection, is transferred uniformly in the entire cooking chamber 101, not to a specific portion of the cooking chamber 101.

A convection motor 760 is provided to the inner surface of the convection cover 720 corresponding to the outside of the convection chamber 710. The convection motor 760 drives the convection fan 740. The convection motor 760 is cooled by air that cools the electronic components and that is introduced through the intake opening 151 of the back plate 150.

Referring to FIGS. 1 and 3, the back plate 150 includes a back cover 770. The back cover 770 has a size adapted to cover the intake opening 151 and the discharge opening 157 of the back plate 150 with the convection cover 720. Thus, between the back plate 150 and the back cover 770 is provided a predetermined passage where air introduced through the intake opening 151 of the back plate 150 is discharged through the discharge opening 157 of the back plate 150.

A third air barrier 530 is provided between the back plate 150 and the back cover 770. The third air barrier 530 divides the space between the back plate 150 and the back cover 770 into a passage through which air that cooled the upper heater assembly 200 flows and a passage through which air that cooled the high voltage transformer 105 flows. The convection motor 760 is provided to the passage through which air that cooled the high voltage transformer 105 flows.

Referring again to FIG. 1, a waveguide 540 is provided to the side surface on the right side of the inner plate 130 in the drawing. The waveguide 540 is configured to guide air that cooled the magnetron 104, and microwaves generated from the magnetron 104, into the cooking chamber 101. To this end, both ends of the waveguide 540 communicate with the cooking chamber 101 and the magnetron 104, respectively.

Referring to FIG. 6, a discharge duct 550 is provided to the side surfaces on the left side of the inner plate 130 in the drawing, corresponding to the opposite side to the waveguide 540. The discharge duct 550 guides downward air that is guided into the cooking chamber 101 by the waveguide 540 and that passes through the cooking chamber 101. To this end, the discharge duct 550 may be provided in a hexahedron shape having an open bottom surface.

Although not shown, the discharge duct 550 includes a temperature sensor and a humidity sensor. The temperature sensor and the humidity sensor sense the temperature and humidity of air passing through the cooking chamber 101 and guided by the discharge duct 550.

The lower heater 780 is disposed between the bottom plate 120 and the base plate 160. The lower heater 780 generates heat for heating foods in the cooking chamber 101 with radiation. The lower heater 780 may include a ceramic heater. The air flowing downward by the first and second fan assemblies 300 cools the lower heater 780.

The turntable motor 790 is disposed between the bottom plate 120 and the base plate 160 corresponding to the front side of the lower heater 780. The turn table motor 790 provides a driving force for rotating a turntable (not shown) rotatably provided to the bottom surface of the cooking chamber 101. The turntable motor 790 is cooled like the lower heater 780 by air moved downward by the first and second fan assemblies 300 and 400.

A fourth air barrier 560 is disposed between the bottom plate 120 and the base plate 160, corresponding to the right side of the lower heater 780 and the turntable motor 790 in the drawing. The fourth air barrier 560 is disposed longitudinally and prevents air, delivered between the bottom plate 120 and the base plate 160 to cool the lower heater 780 and the turntable motor 790, from flowing between the side surface on the right side of the inner plate 130 in the drawing and the side surface on the right side of the outer case 170 in the drawing.

Referring to FIG. 7, the cavity 100 includes a couple of latch boards 810. The latch boards 810 prevent rotation of a door 820 that will be described later, when the door 820 covers the cooking chamber 101. The latch boards 810, in close contact with the both side upper ends of the inner surface of the front plate 140 and with the upper ends of the side surfaces of the inner plate 130, are fixed by a coupling member such as a screw. Thus, the latch boards 810 are fixed to the cavity 100 in two directions perpendicular to each other, so as to prevent an external force generated during opening and closing the door 820 from moving the latch boards 810.

Referring again to FIG. 1, the door 820 is provided to selectively open and close the cooking chamber 101. The door 820 opens and closes the cooking chamber 101 in a pull-down manner where the upper end of the door 820 rotates vertically about a hinge 821 provided to the lower end of the inner surface of the door 820. The upper end of the door 820 is spaced a predetermined distance from the lower end of the control panel 190. The front surface of the door 820 is flush with that of the control panel 190.

The door 820 includes a couple of latch hooks 823. The latch hooks 823 are coupled to the latch boards 810 with the door 820 covering the cooking chamber 101. To this end, the latch hooks 823 are provided to the upper ends in both the side ends at the inner surface of the door 820, corresponding to the latch boards 810.

Hereinafter, passages of the microwave oven will now be described according to this embodiment.

Referring again to FIG. 1, the upper side of the cavity 100 is provided with a first passage P1. The first passage P1 is disposed in any one place between the upper plate 110, the back plate 150, and the upper and side surfaces of the outer case 170. Thus, the first passage P1 includes one portion of the electronic chamber 103 where the electronic components including the magnetron 104 and the high voltage transformer 105 are disposed. The first passage P1 is a place where air flows, in which the air is, by the driving of the first and second fan assemblies 300 and 400, introduced through the inlets 141 of the front plate 140 and the inlet holes 610 of the intake grill 600 and passed through the electronic chamber intake opening 153 of the back plate 150 and delivered to a fourth passage P4 that will be described later.

The upper side of the cavity 100 is also provided with a second passage P2. The second passage P2 includes one portion of the electronic chamber 103 provided with the upper heater assembly 200. One portion of the air that cools the high voltage transformer 105 while flowing through the first passage P1, flows through the second passage P2. The air leaving the second passage P2 is delivered to the first fan 420 of the second fan assembly 400.

A seventh passage P7 is disposed in the upper heater assembly 200. Thus, the seventh passage P7 is separated from the first passage P1, and the upper heater assembly 200 is cooled by air flowing through the seventh passage P7. The air leaving the seventh passage P7 is delivered through a heater intake opening 145 of the back plate 150 to a fifth passage P5 that will be described later.

A third passage P3 is disposed on the right side of the cavity 100 with respect to the drawing. The third passage P3 is defined substantially by the waveguide 540 and the side surface on the right side of the inner plate 130 with respect to the drawing. The third passage P3 is a place where a part of air flowing through the first passage P1 by the driving of the first fan assembly 300, that is, air flowing through the first passage P1 by the driving of the first fan 320 of the first fan assembly 300 flows. That is, air, cooling the magnetron 104 and including microwaves and delivered to the cooking chamber 101, flows through the third passage P3. To this end, both ends of the third passage P3 communicate with the first passage P1 and the cooking chamber 101, respectively.

The left side of the cavity 100 with respect to drawing is provided with an eighth passage P8 (refer to FIG. 6) defined by the side surface on the left side of the inner plate 130 with respect to drawing and the side surface on the left side of the outer case 170 with respect to drawing. The air flowing through the second passage P2 to cool indirectly the upper heater assembly 200 and the air flowing through the third passage P3 to pass through the cooking chamber 101 flow through the eighth passage P8. The eighth passage P8 is entirely separated from the first and second passages P1 and P2 by the second air barrier 520, but substantially, one portion of the eighth passage P8 communicates with the second passage P2 through the communication opening 525 of the second air barrier 520.

The fourth passage P4 is disposed between the back plate 150, and the convection cover 720 and the back cover 770, corresponding to the rear side of the cavity 100. The fourth passage P4 is a place where part of air flowing through the first passage P1, particularly, air cooling the high voltage transformer 105 flows. To this end, the fourth passage P4 communicates with the electronic chamber 103, that is, the first passage P1 through the electronic chamber intake opening 153 of the back plate 150. The convection motor 760 is disposed on the fourth passage P4.

The rear side of the cavity 100 is also provided with the fifth passage P5. The fifth passage P5 is substantially disposed between the back plate 150 and the convection cover 720, and the back cover 770, like the fourth passage P4, and separated from the fourth passage P4 by the third air barrier 530. The fifth passage P5 communicates with the inside of the upper heater assembly 200, that is, with the seventh passage P7 through the heater intake opening 155 of the back plate 150.

The lower side of the cavity 100 is provided with a sixth passage P6 (refer to FIG. 6). The sixth passage P6 is disposed between the bottom plate 120 and the base plate 160. The left end of the sixth passage P6 with respect to the drawing communicates with the lower end of the eighth passage P8. The sixth passage P6 communicates with the fourth passage P4 and the fifth passage P5 through the discharge opening 157 of the back plate 150. The sixth passage P6 also communicates with the indoor space through the outlets 143 of the front plate 140. However, the sixth passage P6 is separated substantially from the first passage P1 by the fourth air barrier 560. The lower heater 780 and the turntable motor 790 are disposed on the sixth passage P6.

Hereinafter, the upper heater assembly 200 of the microwave oven according to this embodiment will now be described in more detail with reference to the accompanying drawings.

Figure 8:
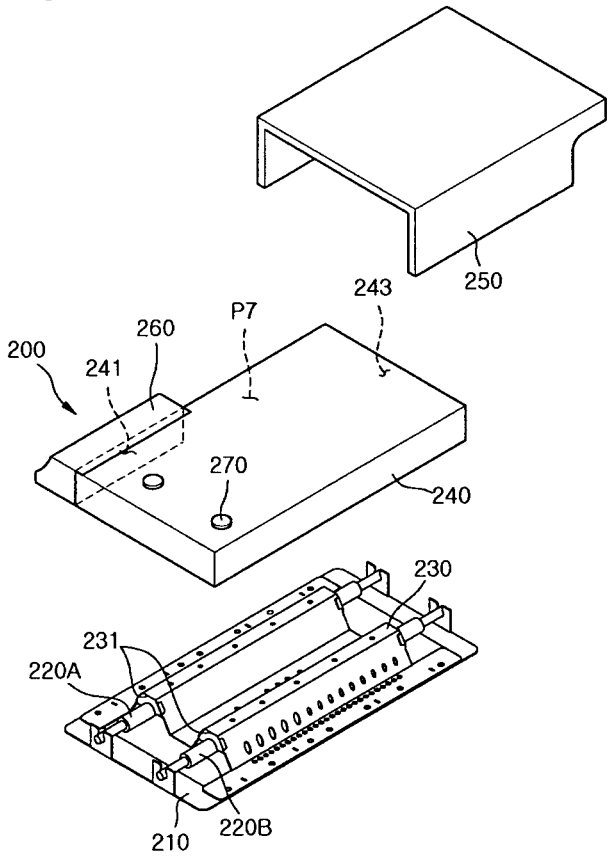
FIG. 8 is an exploded perspective view illustrating an upper heater assembly according to an embodiment.
Figure 9:
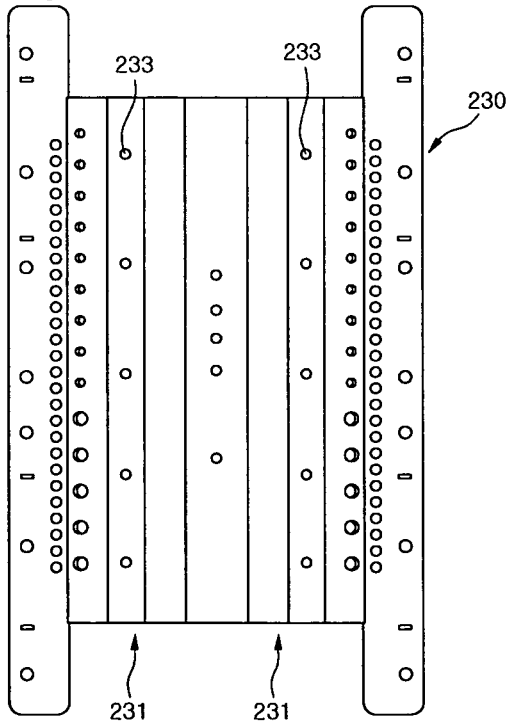
FIG. 9 is a plan view illustrating a reflector according to an embodiment.
Figure 10:
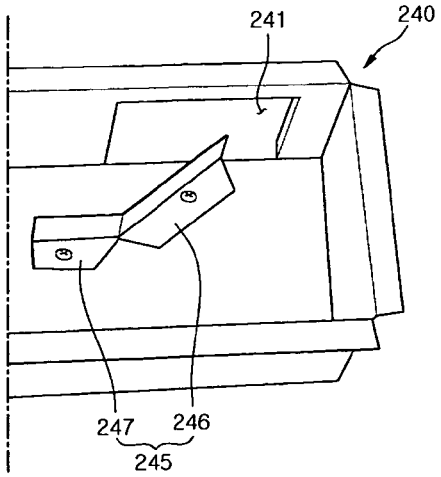
FIG. 10 is a perspective view illustrating a portion of a heater cover according to an embodiment.

FIG. 8 is an exploded perspective view illustrating the upper heater assembly 200 according to the embodiment. FIG. 9 is a plan view illustrating a reflector 230 according to the embodiment. FIG. 10 is a perspective view illustrating a portion of a first heater cover 240 according to the embodiment.

Referring to FIGS. 8 to 10, the upper heater assembly 200 according to this embodiment includes a heater supporter 210, a couple of heaters 220A and 220B, the reflector 230, the first heater cover 240, a second heater cover 250, and a connection duct 260.

The heater supporter 210 is adapted to support the heaters 220A and 220B. The heater supporter 210 is provided in an approximately rectangular frame shape. The heater supporter 210, in the state of supporting the heaters 220A and 220B, is fixed to the upper surface of the upper plate 110 adjacent to the multi-hole part 111 of the upper plate 110.

The heaters 220A and 220B substantially generate heat. The heat from the heaters 220A and 220B heats foods in the cooking chamber 101 with radiation. According to this embodiment, the heaters 220A and 220B include a halogen heater. Since the halogen heater has a greater heating value than other heaters such as a sheathe heater and a ceramic heater, foods are cooked more efficiently. Hereinafter, the heater 220A relatively adjacent to the second fan assembly 400 on the left side with respect to the drawing is referred to as a first heater 220A, and the heater 220B relatively spaced apart from the second fan assembly 400 on the right side with respect to the drawing is referred to as a second heater 220B. When the upper heater assembly 200 is provided to the upper plate 110, that is, when the heater supporter 210 is fixed to the upper plate 110, the heaters 220A and 220B are disposed longitudinally. The heaters 220A and 220B may be inclined at a predetermined angle with respect to the longitudinal axis, like the multi-hole part 111.

The reflector 230 reflects heat of the heaters 220A and 220B to the cooking chamber 101. The reflector 230 is provided with a couple of recesses 231 respectively surrounding the outer surfaces of the heaters 220A and 220B. The recesses 231 are recessed upward, so that a portion of the reflector 230 has an approximately trapezoid cross section, and the recesses 231 are transversely spaced from each other with respect to the drawing.

The recesses 231 are provided with a plurality of cooling holes 233. The cooling holes 233 are adapted to cool the heaters 220A and 220B. Referring to FIG. 9, the cooling holes 233 are provided only to the spaced surfaces of the recesses 231 from each other and to the upper surfaces of the recesses 231. In other words, the cooling holes 233 are not provided to the surfaces of the recesses 231 facing each other. This prevents air cooling one of the heaters 220A and 220B, that is, the heater 220A from moving to the other of the heaters 220A and 220B, that is, the second heater 220B. The cooling holes 233 have various diameters along the passage for air cooling the heaters 220A and 220B. In other words, the cooling holes 233 disposed in an upstream have the greater diameter than the cooling holes 233 disposed in a downstream. Thus, the air for cooling the heaters 220A and 220B cools the heaters 220A and 220B while moving along the passage.

The first heater cover 240 covers the heaters 220A and 220B, and the reflector 230 supported by the heater supporter 210. The first heater cover 240 substantially provides a passage through which air for cooling the heaters 220A and 220B flows. That is, the seventh passage P7 for cooling the heaters 220A and 220B is disposed between the upper surface of the upper plate 110 and the inner surface of the first heater cover 240.

According to this embodiment, the first heater cover 240 is provided in a hexahedron shape having a rectangular cross section. An exit 243 and an entrance 241 are respectively provided to the rear surface and the front end of the left surface in the first heater cover 240 in the longitudinal direction with respect to the drawing. The entrance 241 of the first heater cover 240 receives air discharged through the second discharge part 434 in the second fan 430 of the second fan assembly 400 to cool the heaters 220A and 220B. The air introduced through the entrance 241 of the first heater cover 240 cools the heaters 220A and 220B and is discharged through the exit 243 of the first heater cover 240. The entrance 241 of the first heater cover 240 communicates with the connection duct 260. The exit 243 of the first heater cover 240 communicates with the intake opening 151 of the back plate 150. The positions of the entrance 241 and exit 243 in the first heater cover 240 depend on the relative position of the upper heater assembly 200 with respect to the second discharge part 434 of the second fan 430 in the second fan assembly 400 and the intake opening 151 of the back plate 150.

Referring to FIG. 10, the first heater cover 240 includes a second air guide 245. The second air guide 245 divides and guides the air introduced through the entrance 241 of the first heater cover 240, to the heaters 220A and 220B. To this end, the second air guide 245 includes a first guide part 246 extending from the entrance 241 of the first heater cover 240 to the inside of the first heater cover 240, and a second guide part 247 extending from an end of the first guide part 246 in the longitudinal direction of the first heater cover 240 to divide the air for cooling the heaters 220A and 220B. The first guide part 246 divides the entrance 241 of the first heater cover 240 into two parts having the same cross-sectional flow area. The second guide part 247 is disposed between the heaters 220A and 220B in a manner where a cross-sectional flow area through which air flows toward the second heater 220B is greater than a cross-sectional flow area through which air flows toward the first heater 220A. Thus, regardless of the distance from the second fan assembly 400, the air introduced through the entrance 241 of the first heater cover 240 is distributed uniformly to the heaters 220A and 220B.

The second heater cover 250 prevents heat of the heaters 220A and 220B from being transferred to the electronic components. To this end, the second heater cover 250 covers one portion of the first heater cover 240 adjacent to the high voltage transformer 105.

The connection duct 260 connects the second fan 430 of the second fan assembly 400 to the first heater cover 240. To this end, the both ends of the connection duct 260 communicate with the first and second discharge parts 433 and 434 of the second fan 430 in the second fan assembly 400, and the entrance 241 of the first heater cover 240, respectively.

Referring again to FIG. 8, the first heater cover 240 includes a couple of thermostats 270. The thermostats 270 are adapted to sense the upper heater assembly 200, that is, substantially temperatures of the heaters 220A and 220B when the second fan assembly 400 is not driven. Thus, when the second fan assembly 400 is driven, the thermostats 270 does not sense temperatures of the heaters 220A and 220B.

Hereinafter, the second fan assembly 400 and the second air barrier 520 in the microwave oven according to this embodiment will now be described in more detail with reference to the accompanying drawings.

Figure 11:
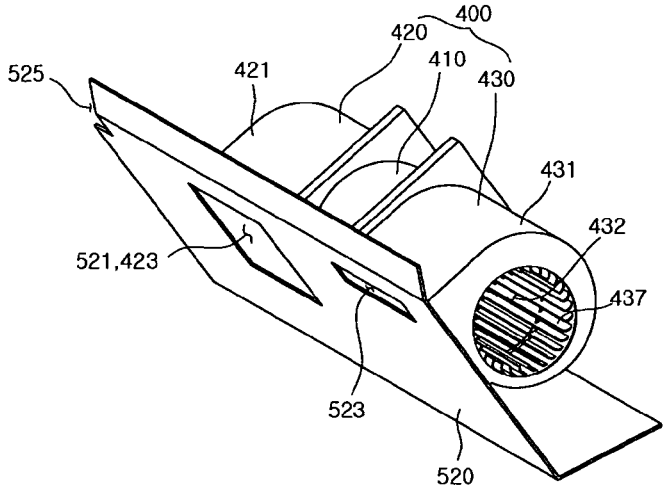
FIG. 11 is a perspective view illustrating a fan assembly and an air barrier according to an embodiment.
Figure 12:
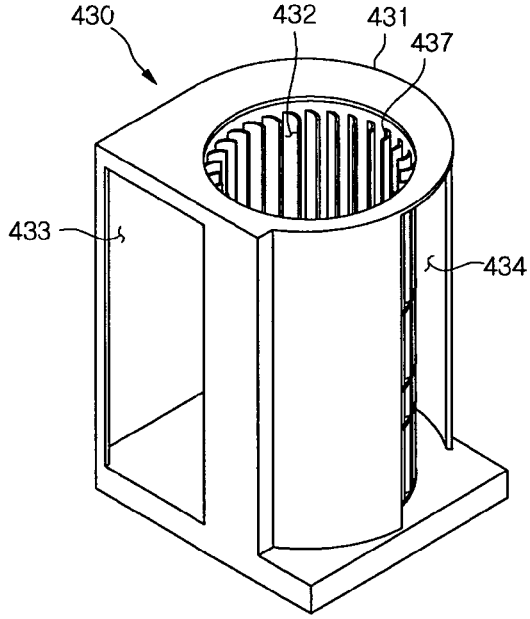
FIG. 12 is a perspective view illustrating a fan of a fan assembly according to an embodiment.

FIG. 11 is a perspective view illustrating the second fan assembly 400 and the second air barrier 520 according to the embodiment. FIG. 12 is a perspective view illustrating the second fan 430 of the second fan assembly 400 according to the embodiment.

Referring to FIGS. 11 and 12, substantially, the second fan assembly 400 is fixed to the cavity 100, with being provided to the second air barrier 520. That is, the second air barrier 520 separates the first passage P1 from the eighth passage P8 as described above, and also functions as a fan-installing bracket for installing the second fan assembly 400.

The second air barrier 520 includes the outlets 521 and 523. Hereinafter, the outlet 521 in the rear end with respect to the drawing is referred to as a first outlet 521, and the outlet 523 in the front end with respect to the drawing is referred to as a second outlet 523. The first and second outlets 521 and 523 of the second air barrier 520 are formed by cutting one portion of the second air barrier 520. The first and second outlets 521 and 523 of the second air barrier 520 have different areas from each other. That is, the second outlet 523 of the second air barrier 520 has the smaller area than the first outlet 521 of the second air barrier 520.

The first fan 420 of the second fan assembly 400 (hereinafter, the 'first fan' means the first fan 420 of the second fan assembly 400) is fixed to the rear surface of the fan motor 410 in the second fan assembly 400 with respect to the drawing. The first fan 420 includes a fan housing 421 and a blower (not shown). An intake part (not shown) is provided to the rear surface of the fan housing 421 in the first fan 420 with respect to the drawing. Air is introduced through the intake part of the first fan 420. A discharge part 423 is provided to a side on the outer surface of the fan housing 421 in the first fan 420. The discharge part 423 of the first fan 420, from which air is discharged, has a rectangular shape with an area corresponding to the first outlet 521 of the second air barrier 520.

The second fan 430 of the second fan assembly 400 (hereinafter, the 'second fan' means the second fan 430 of the second fan assembly 400) is fixed to the front surface of the fan motor 410 in the second fan assembly 400 with respect to the drawing. Like the first fan 420, the second fan 430 includes a fan housing 431 and a blower 437. The fan housing 431 of the second fan 430 is provided in an approximately horizontal cylindrical shape that is the same as that of the fan housing 421 of the first fan 420. The blower 427 of the second fan 430 is rotatable counter clockwise with respect to the drawing, about a horizontal shaft in the fan housing 431 of the second fan 430.

Referring to FIG. 12, the fan housing 431 of the second fan 430 includes an intake part 432 and the first and second discharge parts 433 and 434. The intake part 432 of the second fan 430 is provided to the front surface of the fan housing 431 in the second fan 430 with respect to the drawing, and air is introduced through the intake part 432 of the second fan 430. The first discharge part 433 of the second fan 430 is provided substantially in a rectangular shape having an area corresponding to the second outlet 523 of the second air barrier 520. The second discharge part 434 of the second fan 430 is disposed on the outer surface of the fan housing 431 in the second fan 430, on a side spaced a predetermined angle from the first discharge part 433 of the second fan 430. Thus, the second fan 430 may be referred to as a two-way fan, which discharges air in the different directions from each other through the first and second discharge parts 433 and 434 of the second fan 430.

Hereinafter, airflow in the microwave oven according to the embodiment will now be described in more detail with reference to the accompanying drawings.

First, when the first fan 320 of the first fan assembly 300 is driven, indoor air is introduced into the intake part of the first fan 320 of the first fan assembly 300 through the inlets 141 of the front plate 140 and the inlet holes 610 of the intake grill 600. The introduced indoor air is discharged through the discharge part of the first fan 320 of the first fan assembly 300 to the first passage P1 to cool the magnetron 104. The air discharged through the discharge part of the first fan 320 of the first fan assembly 300 is prevented from being introduced again to the intake part of the first fan 320 of the first fan assembly 300 by the first air bather 510. The air cooling the magnetron 104 collides with the front surface of the back plate 150, so that its flow direction is changed, and then the air, including microwaves generated from the magnetron 104, flows through the third passage P3, i.e., through the waveguide 540 into the cooking chamber 101. The air flowing into the cooking chamber 101 includes oil and steam generated while cooking foods and flows through the eighth passage P8 to the sixth passage P6.

When the second fan 330 of the first fan assembly 300 is driven simultaneously with the driving of the first fan 320 of the first fan assembly 300, indoor air is introduced through the inlets 141 of the front plate 140 and the inlet holes 610 of the intake grill 600 to the intake part of the second fan 330 of the first fan assembly 300. The indoor air introduced to the intake part of the second fan 330 of the first fan assembly 300 is discharged through the discharge part of the first fan 320 of the first fan assembly 300 to the first passage P1 to cool the high voltage transformer 105. A large portion of the air cooling the high voltage transformer 105 is delivered through the electronic chamber intake opening 153 of the back plate 150 to the fourth passage P4. The air delivered to the fourth passage P4 cools the convection motor 760 and is delivered through the discharge opening 157 of the back plate 150 to the sixth passage P6.

When the upper heater assembly 200 is turned on, the second fan assembly 400 is driven. When the first fan 420 of the second fan assembly 400 is driven, indoor air is introduced through the inlets 141 of the front plate 140 and the intake opening 620 of the intake grill 600 to the intake part of the first fan 420 of the second fan assembly 400. Also, a portion of the air discharged through the discharge part of the second fan 330 of the first fan assembly 300 to the first passage P1 to cool the high voltage transformer 105 is also introduced to the intake part of the first fan 420 of the second fan assembly 400. The air introduced into the intake part of the first fan 420 of the second fan assembly 400 cools indirectly the upper heater assembly 200. The air introduced into the intake part of the first fan 420 of the second fan assembly 400 is discharged through the discharge part 423 of the first fan 420 of the second fan assembly 400 and flows through the eighth passage P8 to the sixth passage P6. The second air barrier 520 prevents the air discharged through the discharge part 423 of the first fan 420 of the second fan assembly 400 from being introduced into the intake part of the first fan 420 or the second fan 430 of the second fan assembly 400.

When the second fan 430 of the second fan assembly 400 is driven with simultaneously with the driving of the first fan 420 of the second fan assembly 400, air is introduced through the inlets 141 of the front plate 140 and the intake opening 620 of the intake grill 600 to the intake part 432 of the second fan 430 of the second fan assembly 400. A portion of the air introduced to the intake part 432 of the second fan 430 of the second fan assembly 400 is discharged through the first discharge part 433 of the second fan 430 of the second fan assembly 400 to the eighth passage P8 and delivered to the sixth passage P6. The air discharged through the first discharge part 433 of the second fan 430 of the second fan assembly 400 to the eighth passage P8 is also prevented from being introduced again into the intake part 432 of the second fan 430 of the second fan assembly 400 by the second air barrier 520, like the air discharged through the discharge part of the first fan 420 of the second fan assembly 400 to the eighth passage P8.

One portion of the air introduced to the intake part 432 of the second fan 430 of the second fan assembly 400 is delivered through the second discharge part 434 of the second fan 430 of the second fan assembly 400 into the seventh passage P7, that is, into the connection duct 260 and the first heater cover 240. The air delivered to the seventh passage P7 cools the upper heater assembly 200, and particularly, the heaters 220A and 220B forming the upper heater assembly 200. The air cooling the upper heater assembly 200 is divided and guided into the heaters 220A and 220B by the second air guide 245, respectively, thereby cooling the heaters 220A and 220B more efficiently. The air cooling the upper heater assembly 200 is delivered through the heater intake opening 155 of the back plate 150 to the fifth passage P5 and then flows to the sixth passage P6. The air flowing through the fifth passage P5 is separated from the air flowing the fourth passage P4 by the third air barrier 530. This prevents heating of the convection motor 760 due to the air flowing through the fifth passage P5 in a state where temperature is increased while cooling the upper heater assembly 200.

The air delivered through the fourth, fifth, and eighth passages P4, P5, and P8 to the sixth passage P6 is discharged through the outlets 143 of the front plate 140 to the indoor space. The lower heater 780 and the turntable motor 790 disposed on the sixth passage P6 are cooled by the air through flowing the sixth passage P6. As a matter of course, among the air delivered to the sixth passage P6, the air that cools the upper heater assembly 200 and then is delivered through the fifth passage P5 is high temperature air, but the air delivered through the fourth passage P4 has even lower temperature than this high temperature air, so that the entire temperature of the air flowing through the sixth passage P6 is less than the temperature of the lower heater 780 and the turntable motor 790 by the air delivered through the fourth passage P4. Accordingly, the lower heater 780 and the turntable motor 790 are cooled by the air flowing through the sixth passage P6. The fourth air barrier 560 prevents the air flowing through the sixth passage P6 from passing between the side surface on the right side of the inner plate 130, with respect to the drawing, provided with the seventh passage P7 and the side surface on the right side of the outer case 170 with respect to the drawing and from being introduced again into the intake part of the first fan 420 or the second fan 430 in the first fan assembly 300.

When the upper heater assembly 200 is turned off, for example, in a case of cooking using microwave and/or the convection heater, the first fan assembly 300 is driven, but the second fan assembly 400 is not driven. More particularly, although the upper heater assembly 200 is turned off, the first fan assembly 300 is driven in the same manner as described above. However, since the second fan assembly 400 is not driven, one portion of the air, cooling the high voltage transformer 105 by the second fan 330 of the first fan assembly 300, does not flow through the eighth passage P8. However, since the second air barrier 520 is provided with the communication opening 525, although the second fan assembly 400 is not driven, the portion of the air cooling the high voltage transformer 105 by the first fan 320 of the first fan assembly 300 is delivered through the communication opening 525 of the second air barrier 520 to the eighth passage P8.

In the case of cooking with the convection heat, the convection motor 760 is driven in the state where the convection heater 730 is turned on. Thus, the convection fan 740 is driven, and foods in the cooking chamber 101 are convection heated by heat of the convection heater 730. The air, including the heat of the convection heater 730 and delivered to the cooking chamber 101 by the driving of the convection fan 740, is uniformly guided by the first air guide 750. More particularly, the first air guide 750 guides the air including the heat of the convection heater 730 discharged along the circumference of the convection fan 740 to flow toward the edge of the cooking chamber 101. Thus, the foods in the cooking chamber 101 are more efficiently convection-heated by the heat of the convection heater 730.

MODE FOR THE INVENTION

Hereinafter, microwave ovens according to other embodiments will now be described, in more detail with reference to the accompanying drawings.

Figure 13:
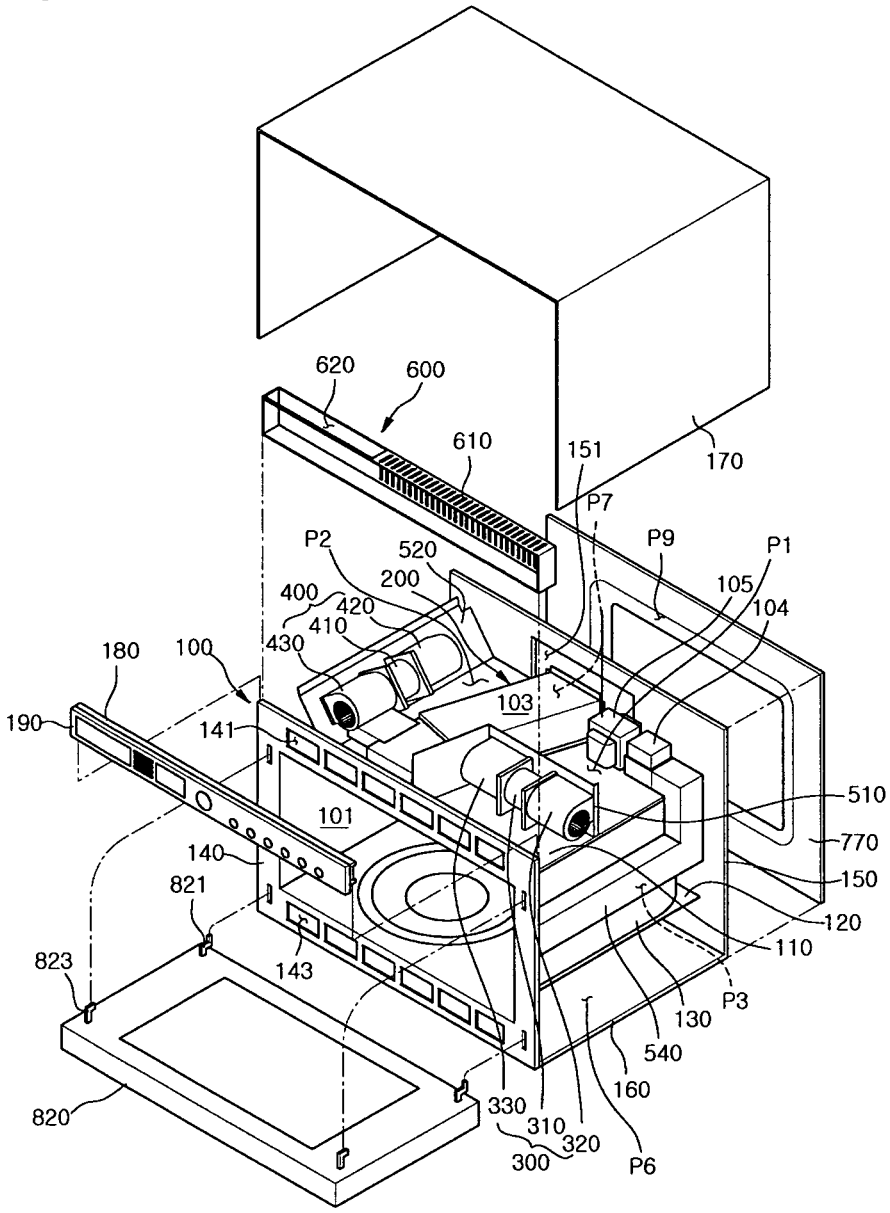
FIG. 13 is an exploded perspective view illustrating a microwave oven according to another embodiment.
Figure 14:
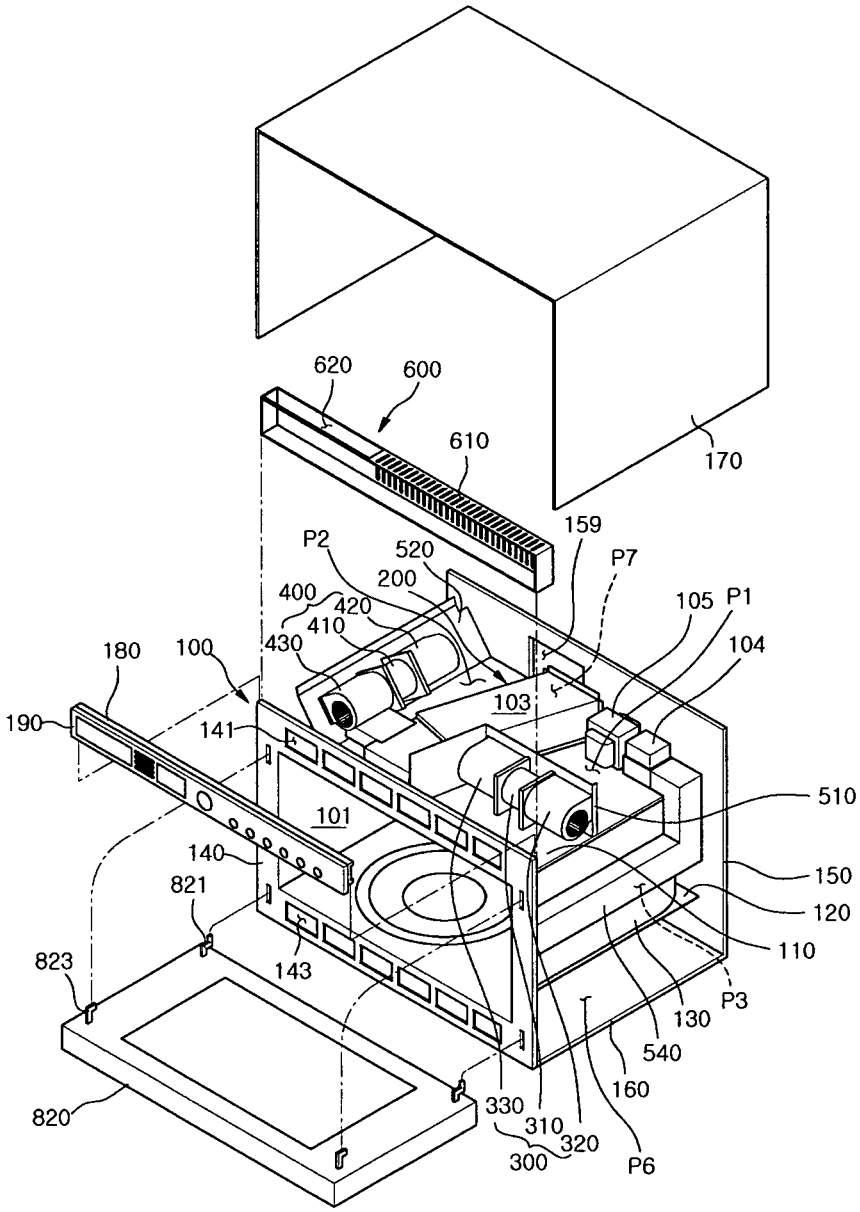
FIG. 14 is an exploded perspective view illustrating a microwave oven according to further another embodiment.

FIG. 13 is an exploded perspective view illustrating the microwave oven according to one embodiment. FIG. 14 is an exploded perspective view illustrating the microwave oven according to another embodiment. The same parts as those of the above described embodiment, will be described using the reference numerals in FIGS. 1 to 12.

Referring to FIG. 13, in the microwave oven according to this embodiment, the various parts forming the convection device in the previous embodiment, that is, the convection chamber 710, the convection cover 720, the convection heater 730, the convection fan 740, the first air guide 750, and the convection motor 760 are omitted. Between the back plate 150 and the back cover 770 is disposed a passage P9 where air passing through the first and second passages P1 and P2 flows. This is because since the convection motor 760 disposed on the passage P9 is omitted, the relatively high temperature air cooling the upper heater assembly 200 is not required to be separated from the relatively low temperature air cooling the magnetron 104 and the high voltage transformer 105. The other components except for this are the same as those of the previous embodiment.

Referring to FIG. 14, the back cover 770 according to the embodiment of FIG. 13 is omitted from the microwave oven according to this embodiment. The back plate 150 is provided only with a communication opening 159, and the intake opening 151 and the heater intake opening 155 of the previous embodiments are omitted, including the electronic chamber intake opening 153 and the heater intake opening 155. The communication opening 159 is formed substantially by cutting a portion of the back plate 150 corresponding to the heater intake opening 155 of the previous embodiments. Air cooling the upper heater assembly 200 while flowing in the second passage P2 is discharged through the communication opening 159 to the outside. Air cooling the magnetron 104 and the high voltage transformer 105 collies with the front surface of the back plate 150 and flows transversely on the cavity 100.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Industrial Applicability

Effects of the microwave ovens according to the embodiments are as follows.

The first and second fan assemblies more efficiently cool the parts forming the microwave oven, and particularly, the electronic components generating microwave and the heaters generating heat. This prevents overheat of the components, so as to improve operation reliability of the microwave oven.

The sizes of the cooling holes supplying air to the heater are different according to the passage where airflow formed by the fan assemblies flows. Thus, the heater is cooled more efficiently.

The air cooling the low temperature components and the air cooling the high temperature components are separated from each other by the their air barrier, so that the air cooling the low temperature components, that is, the low temperature air cools the convection motor. Thus, the convection motor is cooled more efficiently.

In addition, according to the embodiments, the intake grill prevents the exposure of the intake parts of the fan assemblies. Thus, the microwave oven is used safely.

According to the embodiments, air including heat of the convection heat is more efficiently delivered into the cooking chamber through the first air guide. Thus, cooking using the convection device is performed more efficiently.

According to the embodiments, airflow is uniformly delivered to the two heaters through the second air guide. Thus, the heaters are uniformly cooled.

The invention claimed is:

1. A microwave oven comprising:
- a cavity including a cooking chamber;
- a first component and a second component, both at one of surfaces of the cavity;
- a third component at a rest of the surfaces of the cavity provided with the first and second components; and
- a cooling part providing an airflow adapted for cooling the first and third components, the cooling part providing an airflow adapted for cooling the second component and separated from the airflow adapted for cooling the first and third components, wherein the cooling part comprises:
- a first fan providing an airflow directed to a rear side of the cavity to cool the first and third components; and
- a second fan providing an airflow directed transversely on the cavity to cool the second component.

2. The microwave oven according to claim 1, wherein a portion of the air flow provided by the first fan and cooling the first component cools the third component, and a rest of the airflow provided by the first fan and cooling the first component is introduced by the second fan, so as to cool the second component.

3. The microwave oven according to claim 1, wherein a portion of the airflow provided by the first fan and cooling the first component cools the third component, and a rest of the airflow provided by the first fan and cooling the first component passes through the cooking chamber.

4. The microwave oven according to claim 1, wherein the second component generates higher temperature heat than the first and third components do.

5. The microwave oven according to claim 1, wherein the first component comprises at least a magnetron and a high voltage transformer provided to an upper surface of the cavity, and the second component comprises a heater provided to the upper surface of the cavity.

6. The microwave oven according to claim 1, wherein the third component comprises a convection motor provided to a rear surface of the cavity.

7. The microwave oven according to claim 1, wherein a portion of the airflow cooling the first component cools a fourth component provided to a rest of the surfaces of the cavity provided with the first through third components.

8. The microwave oven according to claim 7, wherein the fourth component comprises at least one of a heater and a turntable motor provided to a bottom surface of the cavity.

9. The microwave oven according to claim 1, wherein the airflow cooling the first component is separated from the airflow cooling the second component by a separation member.

10. The microwave oven according to claim 1, wherein the airflow cooling the first component is separated from the airflow cooling the second component by covering the second component.

11. The microwave oven according to claim 1, wherein the second component comprises a heater, and a heater cover covering the heater communicates partially with a discharge part of the cooling part, so that the airflow cooling the first component is separated from the airflow cooling the heater.

12. The microwave oven according to claim 11, wherein the airflow cooling the heater is introduced through an entrance provided to a side surface of the heater cover, and is discharged through an exit provided to a surface of the heater cover perpendicular to the side surface provided with the entrance.

13. The microwave oven according to claim 1, wherein the second component comprises a heater, and the airflow cooling the first component is separated from the airflow cooling the heater by a heater cover covering the heater and by a connection duct having both ends connected to a discharge part of the cooling part and an end of the heater cover.

14. The microwave oven according to claim 1, further comprising a separation member separating the airflow cooling the third component from the airflow cooling the second component.

15. The microwave oven according to claim 1, wherein a portion of the airflow provided by the cooling part cools the first component provided to an upper surface of the cavity and the third component provided to a rear surface of the cavity, and a rest of the airflow provided by the cooling part cools the second component provided to the upper surface of the cavity and is discharged along the rear surface of the cavity to an outside.

16. The microwave oven according to claim 15, wherein the airflow cooling the third component and the airflow cooling the second component flow through an opening provided to a back plate providing the rear surface of the cavity and flow between a convection cover provided to the rear surface of the cavity and a back cover covering the convection cover.

17. The microwave oven according to claim 16, wherein the airflow cooling the third component are separated from the airflow cooling the second component by a separation member disposed between the convection cover and the back cover.

18. A microwave oven comprising:

a cavity including a cooking chamber;

a first component at a first surface of the cavity;

a second component at the first surface of the cavity provided with the first component, the second component generating higher temperature heat than the first component;

a first cooling part providing an airflow adapted to cool the first component; and a second cooling part providing an airflow adapted to cool the second component, wherein the airflow adapted to cool the second component is separated from the airflow adapted to cool the first component, and is discharged to an outside in a state of being spaced apart from a component requiring cooling and provided to the cavity, wherein the airflow provided by the first cooling part cools the first component provided to the first surface of the cavity and a third component provided between a second surface of the cavity and an outer cover, and the airflow provided by the second cooling part cools the second component provided to the first surface of the cavity, and flows, with being separated from the airflow cooling the third component, along the second surface of the cavity, and is discharged to the outside.

19. The microwave oven according to claim 18, wherein the second component comprises:

at least one halogen heater provided to the cavity, the halogen heater being inclined from a direction of the airflow provided by the cooling part;

a reflector reflecting heat of the halogen heater and provided with a plurality of cooling holes through which the airflow provided by the first cooling part is introduced; and a heater cover covering the halogen heater and the reflector and providing a passage where the airflow provided by the first cooling part flows.

20. The microwave oven according to claim 19, wherein the cooling hole provided to an exit of the passage where the airflow provided by the cooling part flows is smaller than the cooling hole provided to an entrance thereof.

21. The microwave oven according to claim 19, wherein sizes of the cooling holes gradually decrease from an entrance of a passage, where an airflow provided by a fan flows, to an exit thereof.

22. The microwave oven according to claim 19, wherein the reflector comprises one or more recesses surrounding an outer surface of the halogen heater, and the cooling hole is provided to the recess.

23. The microwave oven according to claim 22, wherein the recess is longitudinally recessed to transversely space portions of the reflector from each other, so that the recess has a trapezoid cross-section with an open lower surface.

24. The microwave oven according to claim 23, wherein the recess adjacent to the cooling part and surrounding the halogen heater has a surface facing the cooling part, and an upper surface that are provided with the cooling holes, and the recess far from the cooling part and surrounding the halogen heater has an opposite surface to the cooling part, and an upper surface that are provided with the cooling holes.

25. The microwave oven according to claim 18, wherein the second component comprises:

at least two heaters;

a heater cover covering the heaters and providing a passage where the airflow provided by the second cooling part flows; and an air guide dividing and guiding the airflow, provided by the second cooling part, to the heaters.

26. The microwave oven according to claim 25, wherein the air guide comprises:

a first guide provided to a side surface of the heater cover and extending into the heater cover from a position where an entrance, through which the airflow provided by the second cooling part is introduced, is divided into two parts having a same cross-sectional flow area; and a second guide extending in a longitudinal direction of the heater from a front end of the first guide.

27. The microwave oven according to claim 26, wherein the second guide is disposed between the heaters in a manner where a cross-sectional flow area through which air flows toward the heater far from the second cooling part is greater than a cross-sectional flow area through which air flows toward the heater adjacent to the second cooling part.

28. The microwave oven according to claim 18, wherein the first surface is an upper surface of the cavity, and the second surface is a rear surface of the cavity.

29. The microwave oven according to claim 18, wherein the third component is a convection motor.

30. A microwave oven comprising:

an electronic component-cooling passage where a first airflow flows, the first airflow cooling an electronic component provided to an upper surface of a cavity, the first airflow flowing along a rear surface and a bottom surface of the cavity and discharged to an indoor space;

a first fan configured to generate the first airflow;

a heater-cooling passage where a second airflow flows, the second airflow being separated from the first airflow and cooling a heater provided to the upper surface of the cavity; and a second fan configured to generate the second airflow, wherein the second airflow flows along a rear surface and a bottom surface of the cavity and is discharged to an indoor space.

31. The microwave oven according to claim 30, wherein the electronic component provided to the upper surface of the cavity corresponding to the electronic component-cooling passage comprises at least a magnetron.

32. The microwave oven according to claim 30, wherein the rear surface of the cavity corresponding to the electronic component-cooling passage is provided with a convection motor.

33. The microwave oven according to claim 30, wherein a lower side of the cavity corresponding to the electronic component-cooling passage is provided with at least one of a heater and a turntable motor.

34. The microwave oven according to claim 30, further comprising a heater indirect cooling passage where a portion of the air, flowing through the electronic component-cooling passage to indirectly cool the heater, flows, wherein the heater indirect cooling passage is separated from the heater-cooling passage.

35. The microwave oven according to claim 34, wherein the heater-cooling passage is separated from the heater indirect cooling passage by a heater cover covering the heater.

36. The microwave oven according to claim 30, further comprising a cooking chamber passage where a portion of the air flowing through the electronic component-cooling passage and cooling the electronic component flows along a side surface of the cavity and passes through a cooking chamber and flows along another side surface and the bottom surface of the cavity and is discharged into the indoor space.

37. A microwave oven comprising:

a cavity including a cooking chamber and an electronic chamber;

a first passage at an upper surface of the cavity;

a second passage at the upper surface of the cavity, the second passage being separated from the first passage;

a third passage at a side surface of the cavity;

a fourth passage at a rear surface of the cavity;

a fifth passage at the rear surface of the cavity, the fifth passage being separated from the fourth passage; and a sixth passage at a bottom surface of the cavity.

38. The microwave oven according to claim 37, wherein introduced indoor air flows through the first passage, and the air flowing through the first passage cools an electronic component including at least a magnetron provided to the electronic chamber.

39. The microwave oven according to claim 37, wherein introduced indoor air flows through the second passage, and the air flowing through the second passage directly contacts a heater provided to the electronic chamber and cools directly the heater.

40. The microwave oven according to claim 37, wherein a portion of air flowing through the first passage flows through the third passage, and the air flowing through the third passage passes through the cooking chamber.

41. The microwave over according to claim 37, wherein a portion of air flowing through the first passage flows through the fourth passage, and the air flowing through the fourth passage cools a convection motor provided to the rear surface of the cavity.

42. The microwave oven according to claim 37, wherein air flowing through the second passage flows through the fifth passage.

43. The microwave oven according to claim 37, wherein air flowing through at least one of the first through fifth passages flows through the sixth passage, and the air flowing through the sixth passage cools at least one of at least a heater and a turntable motor that are provided to a lower side of the cavity, and is discharged into an indoor space.

44. The microwave oven according to claim 37, further comprising a seventh passage provided to the upper surface of the cavity and separated from the first and second passages.

45. The microwave oven according to claim 44, wherein a portion of air flowing through the first passage flows through the seventh passage, and the air flowing through the seventh passage contacts a heater cover covering a heater provided to the electronic chamber and indirectly cools the heater.

46. The microwave oven according to claim 37, further comprising an eighth passage provided to another side surface of the cavity corresponding to an opposite side to the third passage.

47. The microwave oven according to claim 46, wherein air flowing through a seventh passage and air flowing through the third passage and passing through the cooking chamber flow through the eighth passage.

48. The microwave oven according to claim 37, wherein the second passage is disposed in a heater cover covering a heater provided to the electronic chamber and is separated from the first passage and communicates with the fifth passage.

49. The microwave oven according to claim 37, wherein the third passage is disposed in a waveguide provided to the side surface of the cavity, and communicates with the cooking chamber and the first passage, and is separated from the second passage.

50. The microwave oven according to claim 37, wherein the fourth passage is disposed between a convection chamber provided to the rear surface of the cavity, and a back cover covering the convection chamber, and has an upper end and a lower end that respectively communicate with the first and sixth passages.

51. The microwave oven according to claim 37, wherein the fifth passage is disposed between a convection chamber provided to the rear surface of the cavity, and a back cover covering the convection chamber, and has an upper end and a lower end that respectively communicate with the third and sixth passages.

52. The microwave oven according to claim 37, wherein the fourth and fifth passages are disposed between a convection chamber provided to the rear surface of the cavity, and a back cover covering the convection chamber, and are separated from each other by an air guide disposed between the convection chamber and the back cover.

* * * * *